US006494628B1

(12) United States Patent
Konoshita et al.

(10) Patent No.: US 6,494,628 B1
(45) Date of Patent: Dec. 17, 2002

(54) HEAT-SENSITIVE TRANSCRIPTION PRINTER SYSTEM

(75) Inventors: Yukie Konoshita, Tokyo (JP); Kazuhide Shiratori, Kanagawa (JP); Toshiaki Nakanishi, Chiba (JP); Masanobu Hida, Miyagi (JP); Hiroshi Kikuchi, Miyagi (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/601,520

(22) PCT Filed: Nov. 30, 1999

(86) PCT No.: PCT/JP99/06714

§ 371 (c)(1),
(2), (4) Date: Sep. 12, 2000

(87) PCT Pub. No.: WO00/32406

PCT Pub. Date: Jun. 8, 2000

(30) Foreign Application Priority Data

Dec. 3, 1998 (JP) ..... 10-344562

(51) Int. Cl.[7] ..... B41J 2/315

(52) U.S. Cl. ..... 400/120.01; 400/61; 400/70; 400/76

(58) Field of Search ..... 400/120.01, 76, 400/70, 61

(56) References Cited

U.S. PATENT DOCUMENTS

| | | | | |
|---|---|---|---|---|
| 5,445,463 A | | 8/1995 | Paranjpe et al. | 400/240 |
| 5,682,143 A | * | 10/1997 | Brady et al. | 340/572 |
| 6,128,549 A | * | 10/2000 | Swartz et al. | 700/225 |
| 6,147,604 A | * | 11/2000 | Wiklof et al. | 340/572.1 |

FOREIGN PATENT DOCUMENTS

| | | | |
|---|---|---|---|
| EP | 592198 | | 4/1994 |
| EP | 0654760 A2 | | 5/1995 |
| GB | 2308947 A | | 7/1997 |
| JP | 63-268675 | | 11/1988 |
| JP | 1-290486 | | 11/1989 |
| JP | 6-238926 | | 8/1994 |
| JP | 8-310007 | | 11/1996 |
| JP | 11-291595 | | 10/1999 |
| JP | 00/32406 | | 6/2000 |
| WO | 90/00974 | | 8/1990 |
| WO | WO 98/05508 | * | 2/1998 |

* cited by examiner

*Primary Examiner*—Andrew H. Hirshfeld
*Assistant Examiner*—Charles H. Nolan, Jr.
(74) *Attorney, Agent, or Firm*—Rader, Fishman & Grauer PLLC; Ronald P. Kananen, Esq.

(57) ABSTRACT

A heat-sensitive transcription printer system 100 is made up of a heat-sensitive transcription ink sheet cassette 10 and a heat-sensitive transcription printing device 50 on which said heat-sensitive transcription ink sheet cassette is loaded. On the heat-sensitive transcription ink sheet cassette is bonded an IC label 20 having an IC memory 21, a power receiving/supplying coil 23 and a diode 24 connected to the IC memory 21 and a signal communication coil 22 for performing communication of signals between the IC memory 21 and the heat-sensitive transcription printing device. The inherent discrimination information is previously recorded on the heat-sensitive transcription ink sheet cassette 10 and can be read out from it electrically. In this heat-sensitive transcription printing device 50, the driving power is supplied from a power supply unit 55 through a power supply coil 61, power receiving/supplying coil 23 and the diode 24 to the IC memory 21. A system controller 51 reads out the discrimination information and the using hysteresis information from the IC memory 21 through the signal communication coils 22, 56 to control the printing operation.

7 Claims, 7 Drawing Sheets

HEAT-SENSITIVE TRANSCRIPTION PRINTER SYSTEM

TECHNICAl FIELD

This invention relates to a heat-sensitive transcription printer system comprising a heat-sensitive transcription ink sheet cassette system and a heat-sensitive transcription printer device.

BACKGROUND ART

If plural sorts of the heat sensitive transcription ink sheet cassette or recording sheets are used in a heat-sensitive transcription printer, it is necessary for the heat-sensitive transcription printer to discriminate the ink types, recording characteristics or the number of images. As means therefor, mechanically or optically readable identification information is provided on a cassette housing a heat sensitive transcription ink sheet and a signal pattern of the identification information read on loading the cassette on the heat-sensitive transcription printer is collated to a pattern stored at the outset on a memory of the heat-sensitive transcription printer, by way of discrimination. For example, a seal having recorded thereon an optically readable information pattern, termed a code ring, is provided on a spool adapted for sending out the heat sensitive transcription ink sheet. In use, the rotational operation of the spool is utilized to cause a recognition device provided on the heat-sensitive transcription printer to read out the information by, for example, infrared rays.

It has also been proposed to have a memory mounted on a cassette itself for storing the type of the heat sensitive transcription ink sheet, the number of images or control data of the heat-sensitive transcription printer thereon and to connect the cassette to the heat-sensitive transcription printer via a connector or a contact on loading the cassette on the heat-sensitive transcription printer to read out the stored data.

However, if the mechanically or optically readable identification information is provided on the cassette, ingenuous techniques need to be used to enable the reliable operation of the mechanical or optical switches to enable positive readout of the information signals when the cassette is loaded on the heat-sensitive transcription printer.

Moreover, since the identification information cannot be rewritten in use, the number of residual images of the heat sensitive transcription ink sheets need to be counted on the side of the heat-sensitive transcription printer. There is also a problem that, if the cassettes in use are exchanged, it becomes impossible to count the number of images. In addition, if a memory is mounted on the cassette to exchange the information with the heat-sensitive transcription printer via a connector, it is necessary to provide a memory and a connector circuit in the cassette casing, while it is also necessary to provide electrical contacts to assure positive connection to the heat-sensitive transcription printer.

Since the cassette is liable to modification, it is necessary to provide suitable measures to prevent easy counterfeiting even for the inherent identification information provided on the cassette, such as name of the manufacturer, product number, manufacturing number, product type or recording characteristics. If the above-mentioned code ring is used to afford the identification information, the optically recognizable identification information can readily be modified or modified. Therefore, such a cassette which can be reliably mounted on the heat-sensitive transcription printer, can readily record the using hysteresis information. such as the number of residual images, and which is not susceptible to counterfeiting or modification, as well as a heat-sensitive transcription printer using this cassette, has so far been desired.

DISCLOSURE OF THE INVENTION

It is therefore an object of the present invention to provide a heat-sensitive transcription printer system which is not used in a mistaken fashion in a heat-sensitive transcription printing device, which is able to perform optimum printing and record the using hysteresis information readily and with which it is possible to prevent falsification or modification. It is another object of the present invention to provide a heat-sensitive transcription ink sheet cassette and a heat-sensitive transcription printing device.

In one aspect, the present invention provides heat-sensitive transcription printer system including a heat-sensitive transcription ink sheet cassette and a heat-sensitive transcription printing device on which the heat-sensitive transcription ink sheet cassette is loaded, wherein the heat-sensitive transcription ink sheet cassette includes, on a sheet-shaped substrate, an IC label having an IC memory, a power receiving/supplying means for supplying the power to the IC memory and signal communication means for performing communication of signals between the IC memory and the heat-sensitive transcription printing device. The IC memory has the discrimination information proper to the heat-sensitive transcription ink sheet cassette previously recorded thereon and which is able to electrically read out the discrimination information. The heat-sensitive transcription printing device includes power supplying means for supplying the power through the power receiving/supplying means to the IC memory of the IC label provided on the heat-sensitive transcription ink sheet cassette, control means for collating the discrimination information previously recorded on the IC memory to control the picture printing operation based on the collated results, and signal communication means for performing signal communication between the IC memory and the control means to reproduce the discrimination information previously recorded on the IC memory by the control means in a non-contact fashion.

In another aspect, the present invention provides a heat-sensitive transcription ink sheet cassette used in a heat-sensitive transcription printing device adapted for performing heat-sensitive transcription recording, wherein the heat-sensitive transcription ink sheet cassette includes a sheet-like substrate having an IC memory having the electrically readable discrimination information proper to the heat-sensitive transcription ink sheet cassette previously recorded thereon, power receiving/supplying means for supplying the power to the IC memory and signal communication means for performing signal communication between the IC memory and the heat-sensitive transcription printing device.

In yet another aspect, the present invention provides a heat-sensitive transcription printing device employing a heat-sensitive transcription ink sheet cassette including, on a sheet-shaped substrate, an IC memory, a power receiving/supplying means for supplying the power to the IC memory and signal communication means for having communication of signals with the heat-sensitive transcription printing device, the IC memory having the discrimination information proper to the heat-sensitive transcription ink sheet cassette previously recorded thereon and which is able to electrically read out the discrimination information. The heat-sensitive transcription printing device includes power supplying means for supplying the power through the power receiving/supplying means to the IC memory of the IC label provided on the heat-sensitive transcription ink sheet cassette, control means for collating the discrimination information previously recorded on the IC memory for controlling the picture printing operation based on the collated results, and signal communication means for performing signal communication between the IC memory and the control means to reproduce the discrimination information previously recorded on the IC memory by the control means in a non-contact fashion.

BEST MODE FOR CARRYING OUT THE INVENTION

Figure 1:
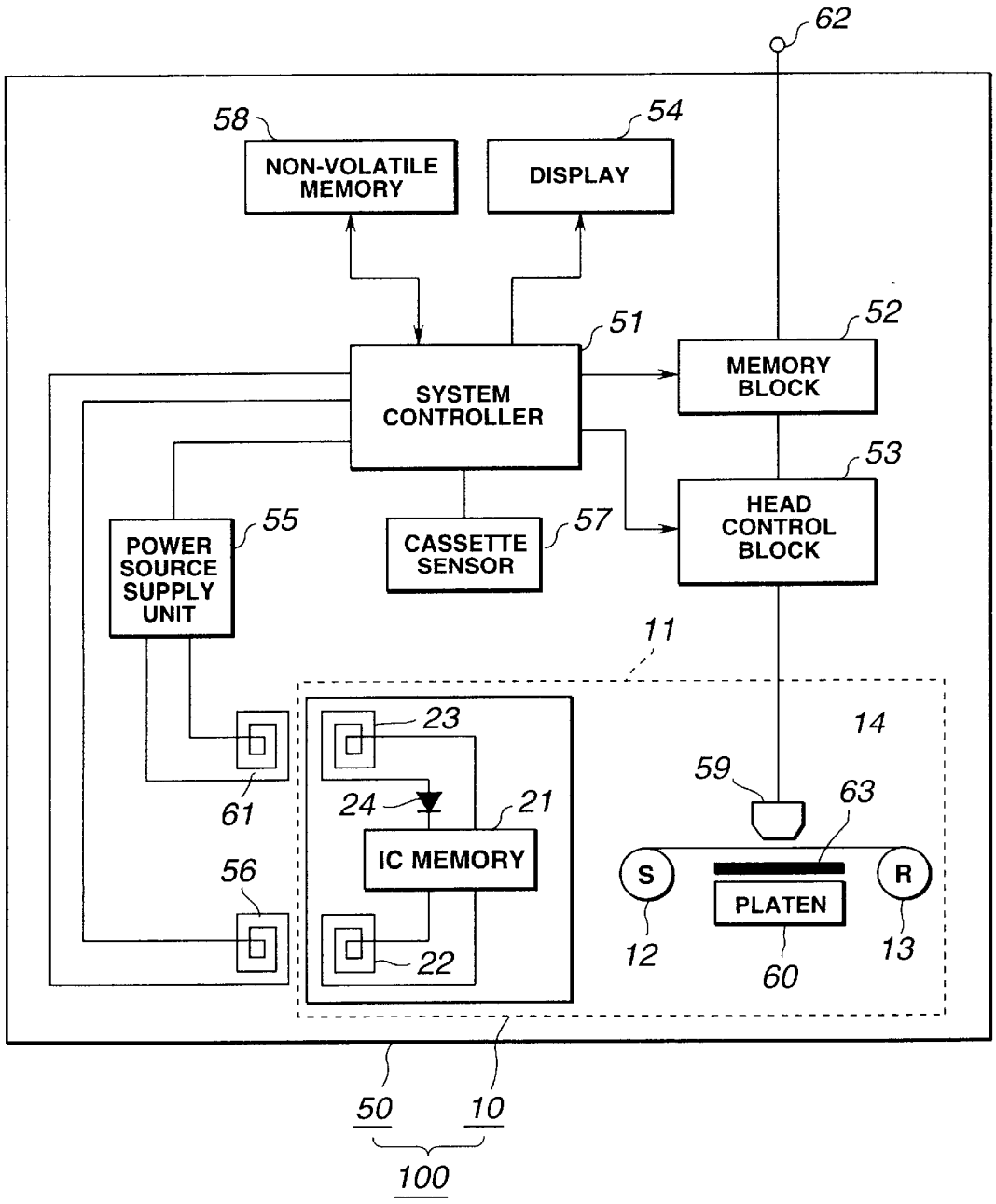
FIG. 1 is schematic block diagram showing the structure of a heat transcription print system embodying the present invention.

A heat-sensitive transcription ink sheet cassette according to the present invention and a heat-sensitive transcription printing device employing the cassette are explained in detail by referring to the drawings.

The present invention is applied to a heat-sensitive transcription printing system 100, as shown for example in FIG. 1.

The heat-sensitive transcription printing system 100, shown in FIG. 1, is made up of a heat-sensitive transcription ink sheet cassette 10, and a heat-sensitive transcription printing device 50, on which the heat-sensitive transcription ink sheet cassette 10 is to be mounted.

The heat-sensitive transcription ink sheet cassette 10 includes a cassette casing 11 which may be loaded on the heat-sensitive transcription printing device 50 and within which are housed a feed-out spool 12 and a take-up spool 13 carrying together a heat-sensitive transcription ink sheet 14. The feed-out spool 12 and the take-up spool 13 are rotated by a rotation driving mechanism, not shown, provided on the heat-sensitive transcription printing device 50, whereby the heat-sensitive transcription ink sheet 14 is reeled out from the feed-out spool 12 so as to be taken up on the take-up spool 13. For the heat-sensitive transcription ink sheet cassette 10, an IC label 20 having an IC memory 21 memorizing the cassette discrimination information or the cassette use hysteresis information is stuck on a lateral side of the cassette casing 11, as shown for example in FIG. 2. To the IC memory 21 are connected an information exchanging coil 22, a power reception/furnishing coil 23 and a diode 24.

The IC memory 21 of the IC label 20, stuck on the heat-sensitive transcription ink sheet cassette 10, memorizes the discrimination information proper to the heat-sensitive transcription ink sheet cassette 10, prior to its shipment, such as the producer's name, product name, product sort or recording characteristics.

The heat-sensitive transcription printing device 50 includes a memory block 52, connected to a system controller 51, a head controller block 53, a display 54, a power supply unit 55, an information exchange coil 56, a cassette sensor 57, a non-volatile memory 58, a thermal head 59 connected to the head controller block 53, a platen 60 provided facing the thermal head 59 and a power supply coil 61 connected to the power supply unit 55.

The information exchange coil 56 and the power supply coil 61 are provided facing the information exchanging coil 22 and the power reception/furnishing coil 23, stuck to the lateral side of the cassette casing 11 of the heat-sensitive transcription ink sheet cassette 10, respectively.

The cassette sensor 57 is configured for optically or mechanically detecting the loading of the heat-sensitive transcription ink sheet cassette 10 on the heat-sensitive transcription printing device 50 to route a detection output to the system controller 51.

In the non-volatile memory 58 is previously stored the discrimination information of the heat-sensitive transcription ink sheet cassette 10 usable in the present heat-sensitive transcription printing device 50.

In this heat-sensitive transcription printing system 100, the heat-sensitive transcription printing device 50, carrying the heat-sensitive transcription ink sheet cassette 10., transmits the AC power supplied from the power supply unit 55 to the power reception/furnishing coil 23 in a contactless fashion by the power supply coil 61 connecting to the power supply unit 55 of the heat-sensitive transcription printing device 50 being electro-magnetically coupled to the to the power reception/furnishing coil 23. The IC memory 21 of the heat-sensitive transcription ink sheet cassette 10 is fed with the driving power corresponding to the AC power transmitted to the power reception/furnishing coil 23 and rectified by the diode 8. The information exchanging coil 22 provided on the heat-sensitive transcription ink sheet cassette 10 and the information exchanging coil 22 provided on the heat-sensitive transcription printing device 50 are electro-magnetically coupled to each other to enable signals to be exchanged in a manner free of contact between the IC memory 21 provided on the heat-sensitive transcription ink sheet cassette 10 and the system controller 51 of the heat-sensitive transcription printing device 50. The heat-sensitive transcription printing device 50 carrying the heat-sensitive transcription ink sheet cassette 10 has signal communication in a contactless fashion with the IC memory 21 of the heat-sensitive transcription ink sheet cassette 10 to enable the information to be read/written and erased for the IC memory 21.

Figure 3:
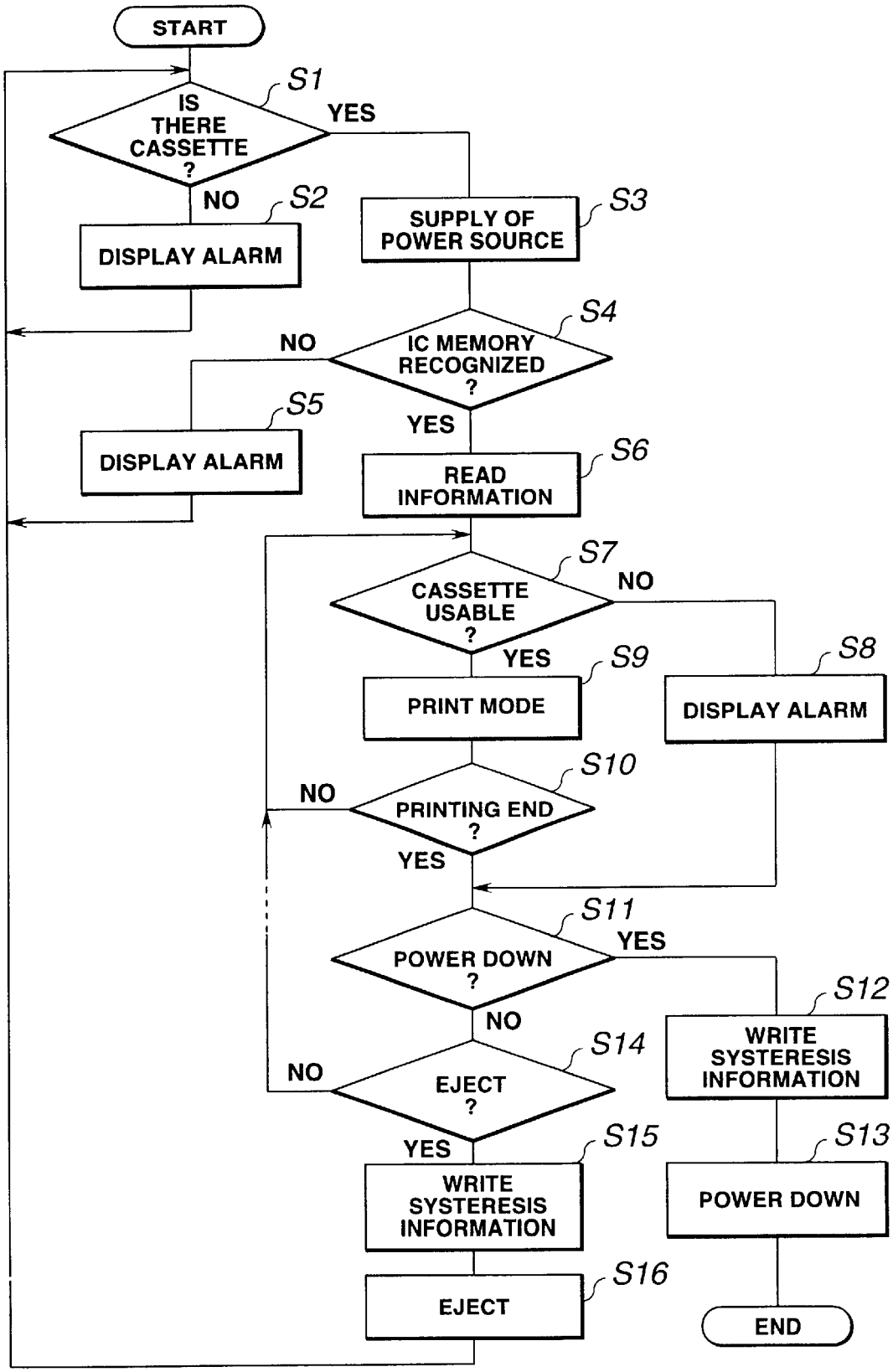
FIG. 3 is a flowchart showing the sequence of a control operation by a system controller of a heat-sensitive transcription printing device of the heat-sensitive transcription printing system.

The system controller 51 of the heat-sensitive transcription printing device 50 in the heat-sensitive transcription printing system 100 performs the control operation in accordance with the procedure shown in the flowchart of FIG. 3.

Specifically, on power up of the heat-sensitive transcription printing device 50, the system controller 51 verifies, based on a detection output by the cassette sensor 57, whether or not the heat-sensitive transcription ink sheet cassette 10 has been loaded in position (step S1). If the result of decision at this step S1 is NO, that is if the heat-sensitive transcription ink sheet cassette 10 is not loaded in position, the system controller 51 demonstrates an alarm on a display 54 to the effect that the heat-sensitive transcription ink sheet cassette 10 is not loaded in position (step S2), after which the system controller 51 reverts to step S1 to repeat the processing of steps S1 and S2 to wait for loading of the heat-sensitive transcription ink sheet cassette 10.

If the result of decision at this step S1 is YES, that is if the heat-sensitive transcription ink sheet cassette 10 has been loaded in position, the system controller 51 turns the power supply unit 55 on to furnish the driving power from the power supply unit 55 through the power supply coil 61, power reception/furnishing coil 23 and the diode 24 to the IC memory 21 of the heat-sensitive transcription ink sheet cassette 10 (step S4).

The system controller 51 then performs authentication processing fusing e.g., a code for authenticating that the product is an authorized product, to check whether or not the IC memory 21 of the heat-sensitive transcription ink sheet cassette 10 can be recognized (step S4).

If the result of decision at this step S4 is NO, that is if there lacks the IC memory 21 of the heat-sensitive transcription ink sheet cassette 10, the IC memory 21 is not an authenticated product or is destructed and cannot be recognized, the system controller 51 demonstrates an alarm on the display 54 to the effect that the IC memory 21 of the heat-sensitive transcription ink sheet cassette 10 is not optimum (step S5). The system controller 51 then reverts to step S1 to repeat the processing of steps S1, S3 and S4 to wait for loading of a new heat-sensitive transcription ink sheet cassette 10.

If the result of decision at this step S4 is YES, that is if there is the IC memory 21 of the heat-sensitive transcription ink sheet cassette 10, the system controller 51 reads out the discrimination information or the use hysteresis information recorded in the IC memory 21 of the heat-sensitive transcription ink sheet cassette 10 to capture the read-out information in an internal memory, not shown.

The system controller 51 then verifies, based on the discrimination information or the use hysteresis information, read out from the IC memory 21, and on the discrimination information or the use hysteresis information, stored in the non-volatile memory 58, whether or not the heat-sensitive transcription ink sheet cassette 10 loaded on the heat-sensitive transcription printing device 50 is usable (step S7).

If the result of decision at this step S7 is NO, that is if the heat-sensitive transcription ink sheet cassette 10 is unusable, an alarm is demonstrated on the display 54 to the effect that the unusable heat-sensitive transcription ink sheet cassette 10 has been loaded (step S8). The system controller 51 then transfers to step S11.

If the result of decision at this step S7 is YES, that is if the heat-sensitive transcription ink sheet cassette 10 is usable, the system controller 51 enters into the printing mode to read out the picture printing data written in a memory block 52 through a data input terminal 62 to drive the thermal head 59 by the head controller block 53 to perform the processing for printing on a printing sheet 63 (step S9).

The system controller 51 then verifies whether or not the printing processing has come to a close (step S10).

If the result of decision at this step S10 is NO, that is if the processing for printing has not come to a close, the system controller 51 reverts to step S6 to continue the printing mode. If the result of decision at this step S10 is YES, that is if the processing for printing has come to a close, the system controller 51 verifies whether or not interruption of the power source of the heat-sensitive transcription printing device has been commanded (step S11).

If the result of decision at this step S11 is YES, that is if the interruption of the power source of the heat-sensitive transcription printing device has been commanded, the system controller 51 writes the use hysteresis of the heat-sensitive transcription ink sheet cassette 10 stored in the non-volatile memory 58 (number of accumulated printing pictures or number of remnant pictures) in the IC memory 21 (step S12). The system controller 51 then interrupts the power of the heat-sensitive transcription printing device 50 (step S13) to terminate the control operation.

If the result of decision at this step S11 is NO, that is if the interruption of the power source has not been commanded, that is if the processing for ejection has not been commanded, the system controller 51 verifies whether or not the processing for ejecting the heat-sensitive transcription ink sheet cassette 10 has been commanded (step S14).

If the result of decision at this step S14 is NO, that is if the processing for ejection has not been commanded, the system controller 51 reverts to step S8 to continue the printing mode. If the result of decision at this step S14 is YES, that is if the processing for ejection has been commanded, the system controller 51 writes the use hysteresis of the heat-sensitive transcription ink sheet cassette 10 recorded in the non-volatile memory 58 (number of accumulated printing pictures or number of remnant pictures) in the IC memory 21 (step S15) and subsequently performs the processing for ejecting the heat-sensitive transcription ink sheet cassette 10 (step S16). The system controller 51 then reverts to step S1 to wait for loading of a new heat-sensitive transcription ink sheet cassette 10.

Meanwhile, the system controller 51 is adapted for writing the error hysteresis information of the ink sheet cassette use hysteresis (number of accumulated printing pictures or number of remnant pictures) in the non-volatile memory 58 each time such information or hysteresis is generated, or at regular time intervals.

For verifying the heat-sensitive transcription ink sheet cassette 10 at the above step S4, the discrimination information proper to the heat-sensitive transcription ink sheet cassette 10 in the IC memory 21 of the IC label 20 is collated to the discrimination information previously registered in the non-volatile memory 58 prior to shipment of the heat-sensitive transcription ink sheet cassette 10. In verifying the heat-sensitive transcription ink sheet cassette 10 at the above step S7, the ink sheet cassette using hysteresis associated with the proper ID number for each heat-sensitive transcription ink sheet cassette loaded on the heat-sensitive transcription printing device 50 (number of accumulated printing pictures or number of remnant pictures) and/or the hysteresis information on the permission or non-permission for use are read out from the non-volatile memory 58 to collate the hysteresis information associated with the ID number proper to the currently loaded heat-sensitive transcription ink sheet cassette 10 to verify whether or not the use is illicit.

By carrying out the verification processing of the heat-sensitive transcription ink sheet cassette 10 at the above steps S4 and S7, it is possible for the present heat-sensitive transcription printing device 50 to prevent mistaken use of the heat-sensitive transcription ink sheet cassette 10 or use of falsified or modified products. The IC memory 21 used in this case may be a read-only IC memory for recording the inherent identification information on fabrication of the heat-sensitive transcription ink sheet cassette 10 or an IC memory capable of reading/writing and erasing the information.

Furthermore, in the verification processing of the heat-sensitive transcription ink sheet cassette 10 at the above step S7, it is verified at the above steps S12 or S15, based on the use hysteresis information of the heat-sensitive transcription ink sheet cassette 10 written in the IC memory 21 of the heat-sensitive transcription ink sheet cassette 10, whether or not the prescribed number of printing sheets is exceeded. thereby placing limitations on the number of printing by the heat-sensitive transcription ink sheet cassette 10.

If an IC memory 21, whose using hysteresis information has been rewritten illicitly, is used, the ID number proper to the above-mentioned IC label 20 can be used and collated to the using hysteresis stored in the non-volatile memory 58 to detect illicit use to place limitations on printing.

It is also possible for the IC memory 21 to previously record the inherent discrimination information, using only an IC memory capable of read/write and erasure operations, and to record and/or reproduce the using hysteresis information. Moreover, it is possible for the IC memory 21 to previously record the inherent discrimination information in a readable first IC memory and to record and/or reproduce the using hysteresis information in a second IC memory capable of read/write and erasure operations.

If a read-only IC memory is used as the IC memory 21, the steps S12 and S15 are omitted and the heat-sensitive transcription ink sheet cassette 10 is verified using only the using hysteresis information of the heat-sensitive transcription printing device 50.

Figure 2:
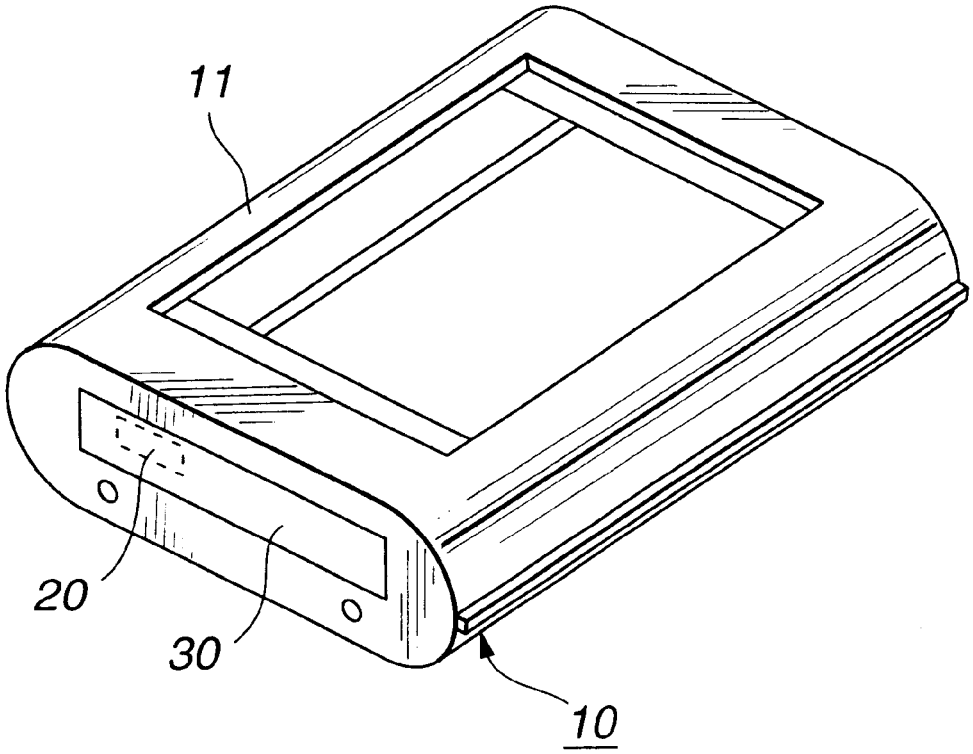
FIG. 2 is a perspective view showing a heat-sensitive transcription ink sheet cassette constituting the heat-sensitive transcription printing system.

In the heat-sensitive transcription ink sheet cassette 10, shown in FIG. 2, an IC label 20 is affixed with an adhesive to the lateral surface of the cassette casing 11, and a protective cover 30 is bonded to overlie the IC label 20.

Figure 4:
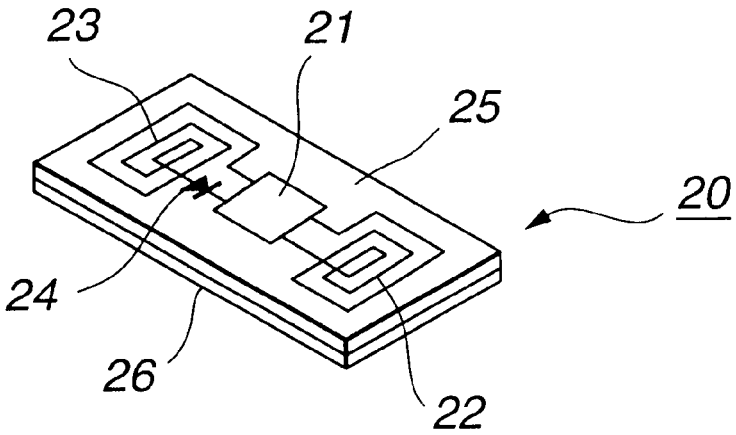
FIG. 4 is a schematic perspective view of an IC label pasted to the heat-sensitive transcription ink sheet cassette.

The IC label 20 includes a sheet-like substrate 25 formed by e.g., a polyethylene terephthalate film, and, arranged on this sheet-like substrate 25, an IC memory 21, an information exchanging coil 22 connected to the IC memory 21, a power supplying/receiving coil 23 and a diode 24, as shown in FIG. 4. The IC memory 21 is capable of electrically reading out the information or electrically erasing the information. An adhesive layer 26 is formed on a surface of the substrate 25 opposite to the surface carrying the IC memory 21 of the IC label 20.

Figure 5:
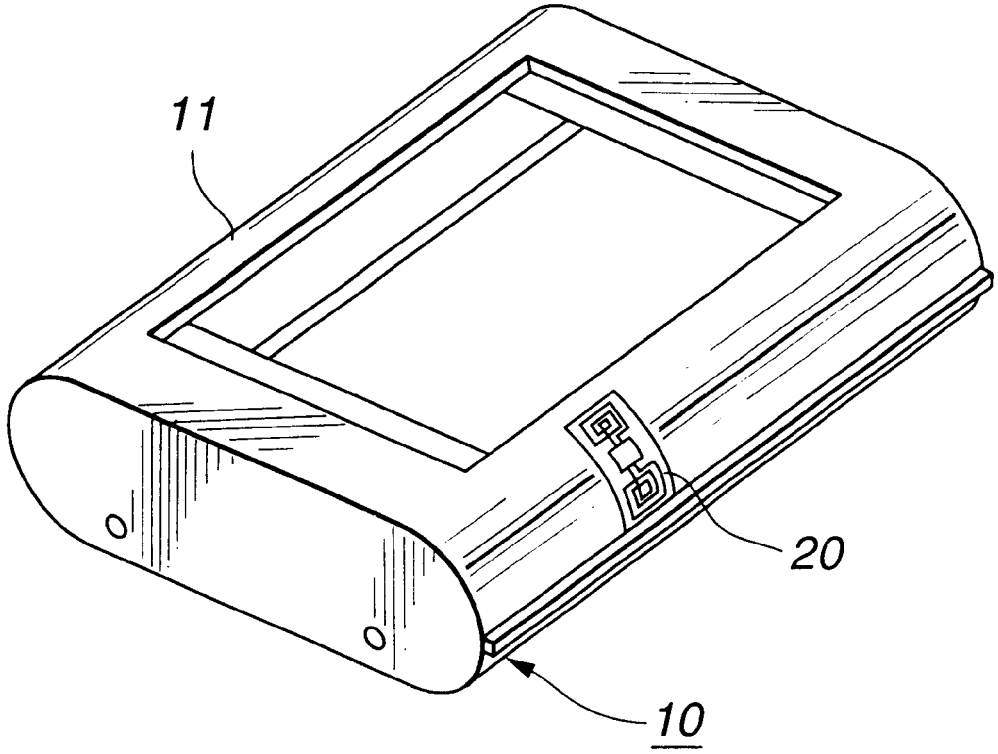
FIG. 5 is a perspective view showing a heat-sensitive transcription ink sheet cassette for showing an example of a pasting position of the IC label.
Figure 6:
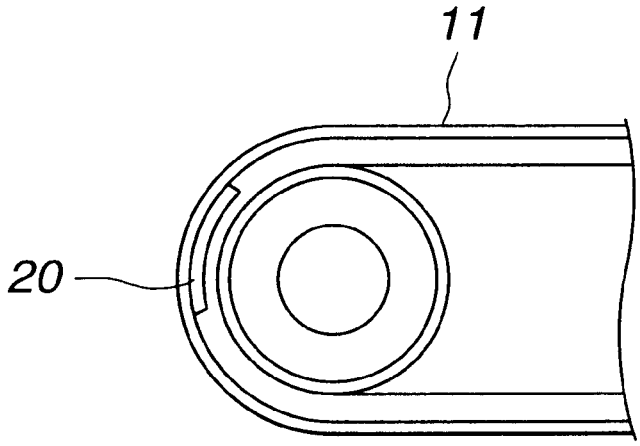
FIG. 6 is a perspective view showing a heat-sensitive transcription ink sheet cassette for showing another example of a pasting position of the IC label.
Figure 7:
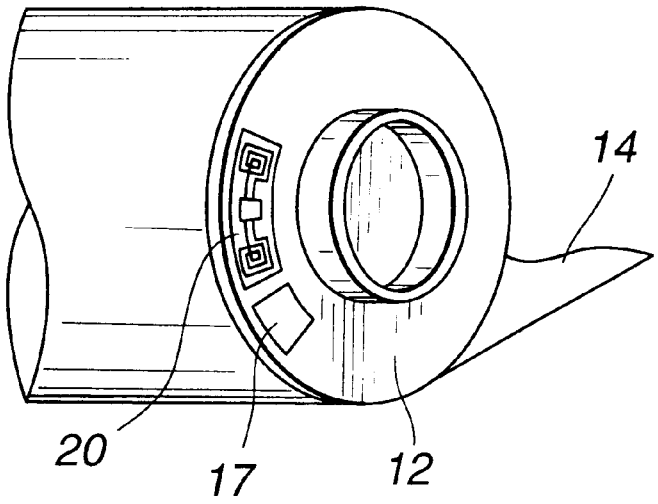
FIG. 7 is a perspective view showing a heat-sensitive transcription ink sheet cassette for showing still another example of a pasting position of the IC label.
Figure 8:
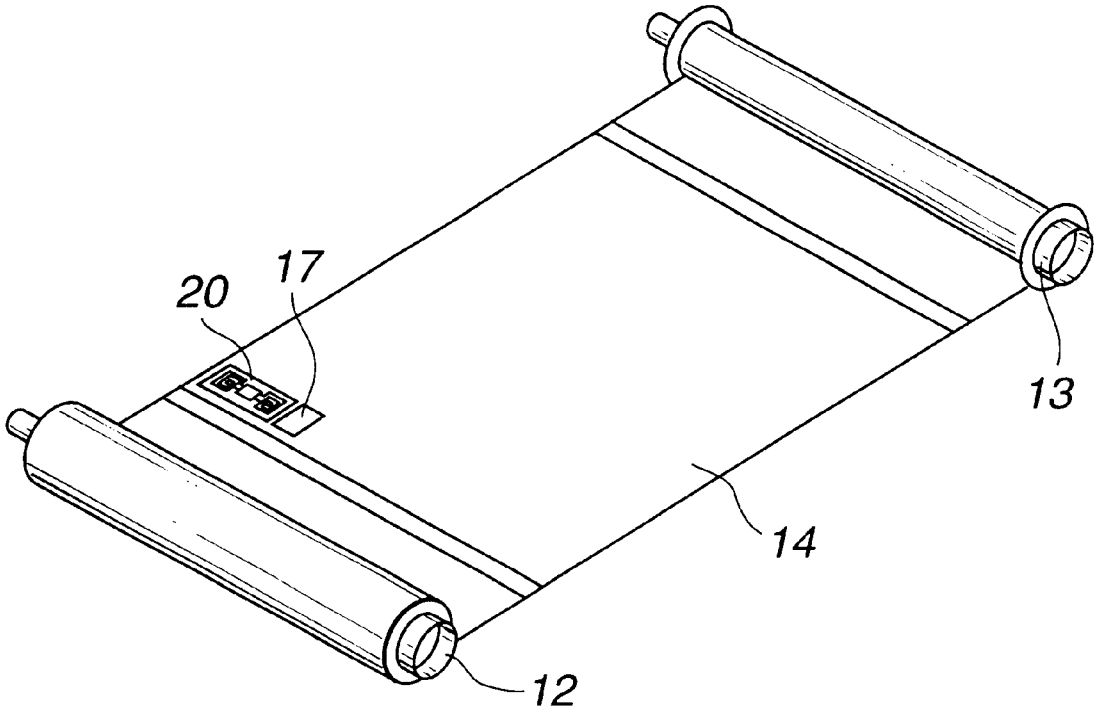
FIG. 8 is a perspective view showing a heat-sensitive transcription ink sheet cassette for showing yet another example of a pasting position of the IC label.

The IC label 20 can be provided by itself without regard to where it is mounted on the cassette casing 11. For example, the IC label 20 can be mounted on a front portion of the cassette casing 11 as shown in FIG. 5 or on a back side thereof as shown in FIG. 6.

The IC label 20 may also be attached to a feed-out spool 12 of the heat-sensitive transcription ink sheet 14.

If, in this case, a reflective mark 17 etc is provided proximate to the IC label 20, the position information of the reflective mark 17 may be detected by optical detection means, such as a reflection photosensor, not shown, on mounting the IC label 20 on the heat-sensitive transcription printing device 50 for achieving position registration with respect to the heat-sensitive transcription printing device 50.

If the IC label 20 is attached to a portion of the heat-sensitive transcription ink sheet 14 not contributing to hest sensitive transcription, and the reflective mark 17 is provided as appropriate, it is possible to establish position registration with respect to the heat-sensitive transcription printing device 50 by detecting the position information of the IC label 20 by optical detection means, such as transmission optical sensor, not shown. It is noted that the heat-sensitive transcription ink sheet 14 is run by the feed-out spool 12 and the take-up spool 13.

Figure 9:
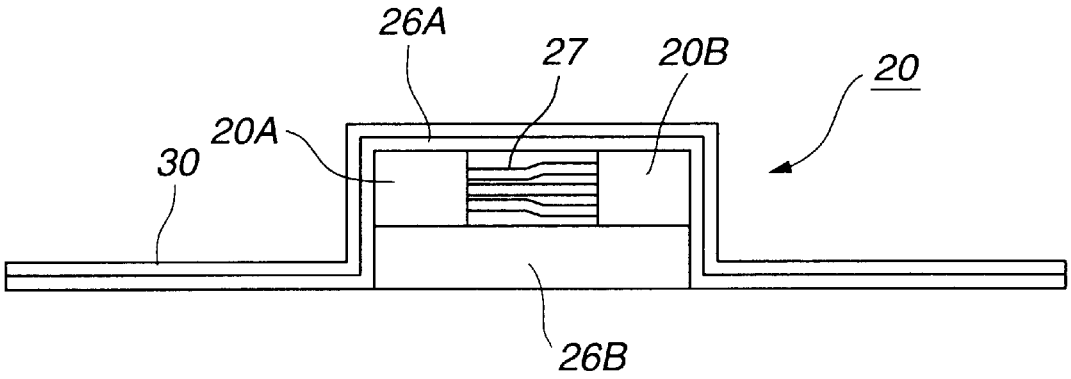
FIG. 9 is a schematic cross-sectional view showing an illustrative structure of the IC label.
Figure 10:
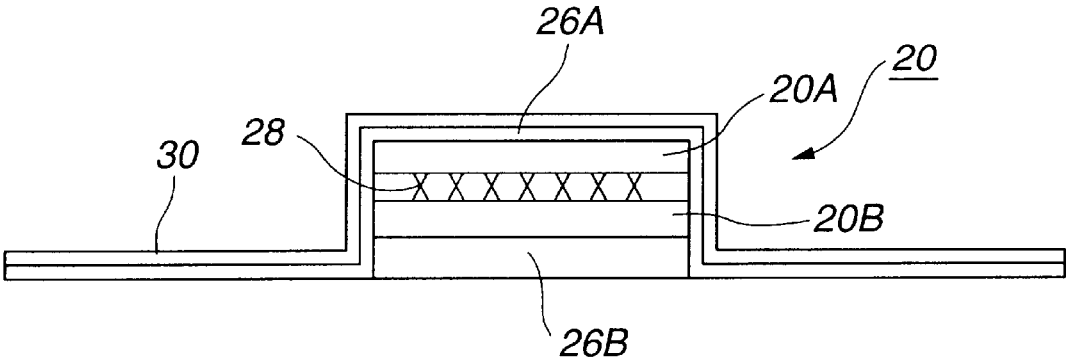
FIG. 10 is a schematic cross-sectional view showing another illustrative structure of the IC label

The IC label 20 may be configured as shown for example in FIGS. 9 and 10 to prevent re-use on re-bonding.

That is, the IC memory 21, information exchanging coil 22 and/or the power supplying/receiving coil 23 are each split into plural modules. These modules are interconnected by wires and/or contacts.

The respective modules, both upper and lower, are coated with adhesive layers 20A, 20B and bonded with an adhesive to e.g., a cassette casing. A protective cover 30 is also attached by an adhesive for overlying each module.

A case in which the IC label 20 is made up of two modules 20A, 20B is explained.

The same applies for a case in which the number of modules exceeds 2.

The modules 20A, 20B are interconnected by a structure, shown in FIG. 9 in which, if it is attempted to dismount the IC label 20 from the heat-sensitive transcription ink sheet cassette 10, the wire 27 is broken, or by a structure, shown in FIG. 10, in which, in the same case, the contact 28 is separated and isolated.

In the IC label 20, constructed as shown in FIG. 9, the module 20A is secured by an adhesive to an upper adhesive layer 26A with a larger adhesive force than the tensile strength of the wire 27, whilst the module 20B is secured to a lower adhesive layer 26B with an adhesive force than the tensile strength of the wire 27.

In the IC label 20, configured as shown in FIG. 9, the module 20A is secured by an adhesive to an upper adhesive layer 26A with a larger adhesive force than the bonding strength of the contact 28, whilst the module 20B is secured to a lower adhesive layer 26B with an adhesive force than the bonding strength of the contact 28.

That is, by setting the destruction strength between the modules 20A and 20B so as to be smaller than that between the modules 20A and 20B, it is possible to disrupt the connection between the module 20A and the module 20B when dismounting the IC label 20.

In order to frustrate an attempt to use the modules A and B by regeneration and bonding after separation thereof, it is desirable to complicate the pattern of the wire 27 or the contact 28, to induce shorting across contacts after attempted re-bonding or to provide for an irregular distance between contacts due to distortion on peeling off the IC label 20 to render the position registration in re-bonding difficult.

In the heat-sensitive transcription printing system 100, described above, it is possible to prohibit mistaken use of the heat-sensitive transcription ink sheet cassette 10 or of falsified or modified products by recording the name of a producer, a product name, a product sort or recording characteristics as the discrimination information proper to the heat-sensitive transcription ink sheet cassette 10, in advance of shipment of the heat-sensitive transcription ink sheet cassette 10, by recording the discrimination information proper to the information processing device by a system controller 51 of the heat-sensitive transcription printing device 50 when mounting the heat-sensitive transcription printing system 100 on the heat-sensitive transcription printing device 50 for use, and by collating the recorded discrimination information to that of the IC in memory 21. The IC memory 21 used in such case may be a read-only IC memory for recording the proper discrimination information in producing the heat-sensitive transcription ink sheet cassette 10, or an IC memory capable of reading/writing and erasure.

The method for utilizing the inherent ID number to limit the number of times of printing, using a read-only memory or an IC memory capable of reading/writing and erasure, is hereinafter explained.

The number of times of printing can be limited by recording the using hysteresis on the heat-sensitive transcription printing device 50 from one ID number proper to the ink ribbon to another.

An ID proper to an IC memory 21 is impaired to each IC memory 21. The heat-sensitive transcription printing device 50 reads out an ID number to register the ID number in the non-volatile memory 58 in the heat-sensitive transcription printing device 50. In the non-volatile memory 58 in the heat-sensitive transcription printing device 50 is recorded the information relating to the ink sheet cassette use hysteresis relevant to the read-out proper ID number (number of accumulated printing pictures or number of remnant pictures) and/or the information relating to the permission or non-permission from one read-out proper ID number to another.

The authentication employing a proper ID number is carried out as follows:

1. An ink sheet cassette is set on the heat-sensitive transcription printing device.
2. The proper ID number is read into the heat-sensitive transcription printing device from an IC memory.
3. If, on collation to the using hysteresis of the proper ID number stored in the heat-sensitive transcription printing device, the use in question is verified to be illicit, the printing is not allowed.

Also, if, in this heat-sensitive transcription printing system 100, the heat-sensitive transcription ink sheet cassette 10 is attached to the heat-sensitive transcription printing device 50 in use, the using hysteresis information, such as tile number of remnant pictures, can be detected by recording and reproducing the information relating to the number of pictures in use on or from the IC memory 21 of the IC label 20 . The IC memory 21 used in such case needs to be an IC memory that is able to read/write and erase the information.

It is possible to limit printing in excess of a prescribed number of printing pictures using this using hysteresis information.

That is, the system controller 51 of the heat-sensitive transcription printing device 50 controls the power supply unit 55 to induce an excess induction current in the IC memory 21 of the IC label 20 at a time point when the number of accumulated printed sheets reaches a prescribed number to burn off the circuit to disable subsequent use of the IC label. If such an IC memory 21 in which the using hysteresis information has been rewritten illicitly is used, the above-mentioned ID number of the IC label 20 is used and collated to the using hysteresis stored in the heat-sensitive transcription printing device 50 to detect the illicit use to limit the printing.

In the heat-sensitive transcription printing device 50 in the present heat-sensitive transcription printing system 100, both the discrimination information proper to each heat-sensitive transcription ink sheet cassette 10 and the using hysteresis information are used to verify whether or not the loaded heat-sensitive transcription ink sheet cassette 10 is usable. Alternatively, only the inherent discrimination information may be used for verification.

The system controller 51 in the heat-sensitive transcription printing device 50 is configured for writing the using hysteresis information in the IC memory 21 of the heat-sensitive transcription ink sheet cassette 10 from the non-volatile memory 58 on power down and at the time of ejection of the heat-sensitive transcription ink sheet cassette 10. However, the using hysteresis information may be read out every time the ink sheet cassette using hysteresis information is produced or incidentally from the non-volatile memory 58 for writing in the IC memory 21. Alternatively, the using hysteresis information may be directly written in the IC memory 21 of the heat-sensitive transcription ink sheet cassette 10 every time the ink sheet cassette using hysteresis information is produced.

Figure 11:
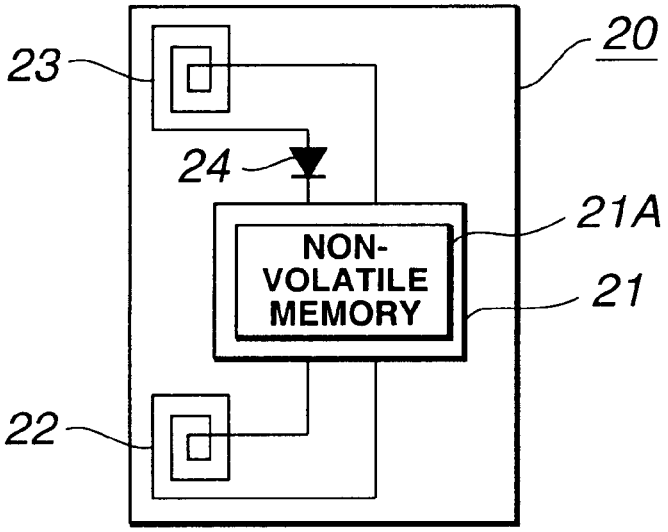
FIG. 11 is a schematic view showing an illustrative structure of the IC memory provided with the IC label.
Figure 12:
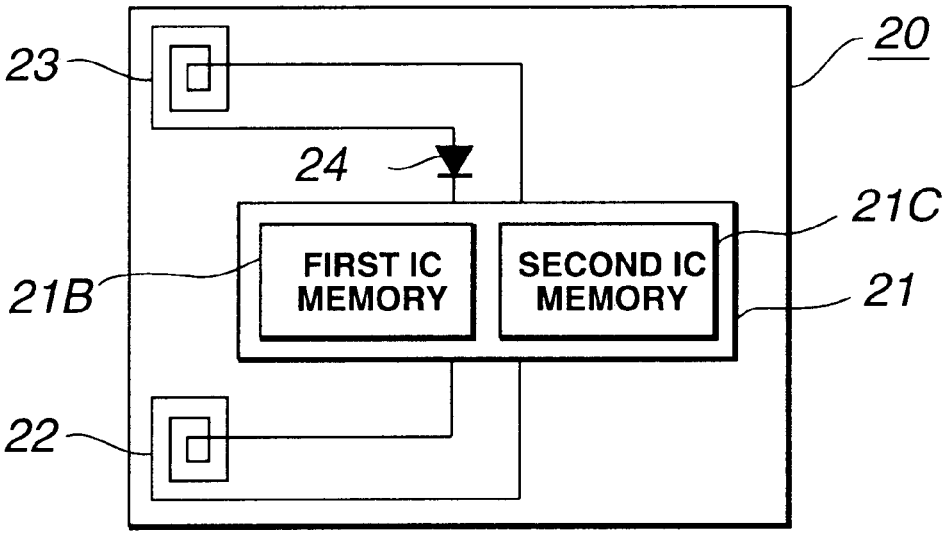
FIG. 12 is a schematic view showing another illustrative structure of the IC memory.

If both the inherent discrimination information and the using hysteresis information are to be recorded in the IC memory 21 of the heat-sensitive transcription ink sheet cassette 10, only a sole IC memory having enclosed therein a non-volatile memory 21A, capable of reading/writing and erasing the information, as shown in FIG. 11, may be used to pre-record the inherent discrimination information to record and/or reproduce the using hysteresis information. Alternatively, the inherent discrimination information may be pre-recorded in the read-only first IC memory 21B, and the using hysteresis information may be recorded and/or reproduced using a second IC memory 21C capable of recording and/or reproducing the using hysteresis information.

Thus, according to the present invention, in which the discrimination information proper to the heat-sensitive transcription ink sheet cassette 10 can be easily collated by the heat-sensitive transcription printing device 50, it is possible to prevent mistaken use of the heat-sensitive transcription ink sheet cassette 10. Moreover, by recording the discrimination information proper to the heat-sensitive transcription ink sheet cassette 10 on the IC memory 21, it becomes possible to render decoding of the discrimination information difficult to prevent the heat-sensitive transcription ink sheet cassette 10 from being falsified or c modified. Since the using hysteresis information of the heat-sensitive transcription ink sheet cassette 10 can be detected easily, the using hysteresis information such as the number of remnant pictures can be acquired easily. In addition, with the present invention, in which the IC label 20 is used, information exchange between the heat-sensitive transcription ink sheet cassette 10 and the heat-sensitive transcription printing device 50 can be performed contactlessly. Moreover, by using a structure which renders exchange of the IC label 20 difficult, it is possible to prevent the heat-sensitive transcription ink sheet cassette 10 from being falsified or modified.

What is claimed is:

1. A heat-sensitive transcription printer system comprising:

a heat-sensitive transcription ink sheet cassette and a heat-sensitive transcription printing device on which said heat-sensitive transcription ink sheet cassette is loaded, wherein said heat-sensitive transcription ink sheet cassette includes, on a sheet-shaped substrate, an IC label having an IC memory, a power receiving/supplying means and a signal communications means mounted on the IC label, the power receiving/supplying means operative for supplying the power to said IC memory and the signal communication means operative for performing communication of signals between said IC memory and said heat-sensitive transcription printing device, said IC memory having the discrimination information proper to the heat-sensitive transcription ink sheet cassette previously recorded thereon and which is able to electrically read out said discrimination information;

said heat-sensitive transcription printing device including power supplying means for supplying the power in a non-contact fashion through said power receiving/supplying means to said IC memory of said IC label, control means for collating the discrimination information previously recorded on said IC memory to control the picture printing operation based on the collated results, and signal communication means for exchanging data with said IC memory and performing signal communication between said IC memory and the control means to reproduce the discrimination information previously recorded on said IC memory by said control means, said signal communication means exchanging data and performing signal communications in a non-contact fashion, wherein said IC memory is capable of electrically reading/writing and erasing the information;

said control means of the heat-sensitive transcription printing device detects using hysteresis information of the heat-sensitive transcription ink sheet cassette recorded on and reproducible from said IC memory in a non-contact fashion to control the picture printing operation based on said using hysteresis information.

2. The heat-sensitive transcription printer system according to claim 1 wherein said IC label of said heat-sensitive transcription ink sheet cassette includes a first IC memory capable of electrically reading out the information and a second IC memory capable of electrically reading out/writing and erasing the information;

said control means non-contact reproduces the discrimination information of said heat-sensitive transcription ink sheet cassette previously recorded on said first IC memory for collation, said control means contactlessly recording and reproducing the using hysteresis information of said heat-sensitive transcription ink sheet cassette on or from said second IC memory to control the picture printing operation based on said discrimination information and the using hysteresis information.

3. A heat-sensitive transcription printing device employing a heat-sensitive transcription ink sheet cassette including, on a sheet-shaped substrate, an IC memory provided on an IC label, a power receiving/supplying means for supplying the power to said IC memory and signal communication means for having communication of signals with said heat-sensitive transcription printing device, said IC memory having discrimination information proper to the heat-sensitive transcription ink sheet cassette previously recorded thereon and which is able to electrically read out said discrimination information, wherein the heat-sensitive transcription printing device comprises:

power supplying means for supplying the power through said power receiving/supplying means in a non-contact fashion to said IC memory of said IC label provided on said heat-sensitive transcription ink sheet cassette, control means for collating the discrimination information previously recorded on said IC memory for controlling the picture printing operation based on the collated results, and signal communication means for performing signal communication between said IC memory and the control means to reproduce the discrimination information previously recorded on said IC memory by said control means in a non-contact fashion, wherein said control means contactlessly records and reproduces using hysteresis information of said heat-sensitive transcription ink sheet cassette on or from an IC memory to control the picture printing operation based on said using hysteresis information, said IC memory being provided on said IC label and the information being recorded and recorded on or from said IC memory electrically.

4. The heat-sensitive transcription printing device according to claim 3 wherein said control means contactlessly reproduces the discrimination information of said heat-sensitive transcription ink sheet cassette previously recorded on a first IC memory from an IC memory for collation, said first IC memory being provided on said IC label and the information being recorded and recorded on or from said first IC memory electrically, said control means contactlessly recording/reproducing the using hysteresis information of said heat-sensitive transcription ink sheet cassette on or from said second IC memory capable of contactlessly reading/writing and erasing the information to control the picture printing operation based on said discrimination information and the using hysteresis information.

5. The heat-sensitive transcription printing device according to claim 3 wherein said control means controls said power supplying means at a time point when the accumulated number of printed sheets has reaches a prescribed number to induce excess current in a circuit of said IC label to burn off the circuit to disable the IC label to be used subsequently.

6. The heat-sensitive transcription printing device according to claim 3 wherein said control means reads out the inherent ID number registered in an IC memory of the heat-sensitive transcription ink sheet cassette to record the using hysteresis information of the heat-sensitive transcription ink sheet cassette associated with the inherent ID number in a non-volatile memory to authenticate the heat-sensitive transcription ink sheet cassette and detect the using hysteresis using said using hysteresis information.

7. The heat-sensitive transcription printing device according to claim 3 wherein said control means when reading out the data read out from the IC memory of the heat-sensitive transcription ink sheet cassette in a transient memory, prepares at least one backup of the read-out data simultaneously to save at least one of said backup data in a non-volatile memory.

* * * * *

UNITED STATES PATENT AND TRADEMARK OFFICE

CERTIFICATE OF CORRECTION

PATENT NO. : 6,494,628 B1
DATED : December 17, 2002
INVENTOR(S) : Yukie Konoshita et al.

It is certified that error appears in the above-identified patent and that said Letters Patent is hereby corrected as shown below:

Column 12,
Line 41, replace “reaches” with -- reached --.

Signed and Sealed this

Twenty-first Day of October, 2003

JAMES E. ROGAN
*Director of the United States Patent and Trademark Office*